US005402960A

United States Patent [19]

Oliver et al.

[11] Patent Number: 5,402,960

[45] Date of Patent: Apr. 4, 1995

[54] CORELESS SURFACE WINDER AND METHOD

[75] Inventors: Lawrence J. Oliver; Richard J. Vigneau, both of Green Bay, Wis.

[73] Assignee: Paper Converting Machine Company, Green Bay, Wis.

[21] Appl. No.: 108,105

[22] Filed: Aug. 16, 1993

[51] Int. Cl.[6] ..... B65H 18/20; B65H 20/02

[52] U.S. Cl. ..... 242/527.1; 242/541.2; 242/542.2; 242/542.4; 242/547; 242/DIG. 3

[58] Field of Search ..... 242/527, 527.1, 527.3, 242/527.4, 541.2, DIG. 3, 542, 542.1, 542.4, 548, 542.2, 547, 535.1

[56] References Cited

U.S. PATENT DOCUMENTS

| | | | |
|---|---|---|---|
| Re. 28,353 | 3/1975 | Nystrand et al. | 242/527.1 |
| 3,065,505 | 11/1962 | Pratt et al. | 242/DIG. 3 X |
| 4,828,195 | 5/1989 | Hertel et al. | 242/542 |
| 5,248,106 | 9/1993 | Biagiotti | 242/542 X |

*Primary Examiner*—John Q. Nguyen

*Attorney, Agent, or Firm*—Tilton, Fallon, Lungmus & Chestnut

[57] ABSTRACT

A coreless surface winder and method wherein one of the winding rollers is accompanied by a slightly spaced apart arcuate dead plate which operates to cause a folded leading edge on a transversely severed web to roll upon itself and develop an incipient log which thereafter is completed in a conventional three roll cradle to provide a coreless retail sized roll.

16 Claims, 3 Drawing Sheets

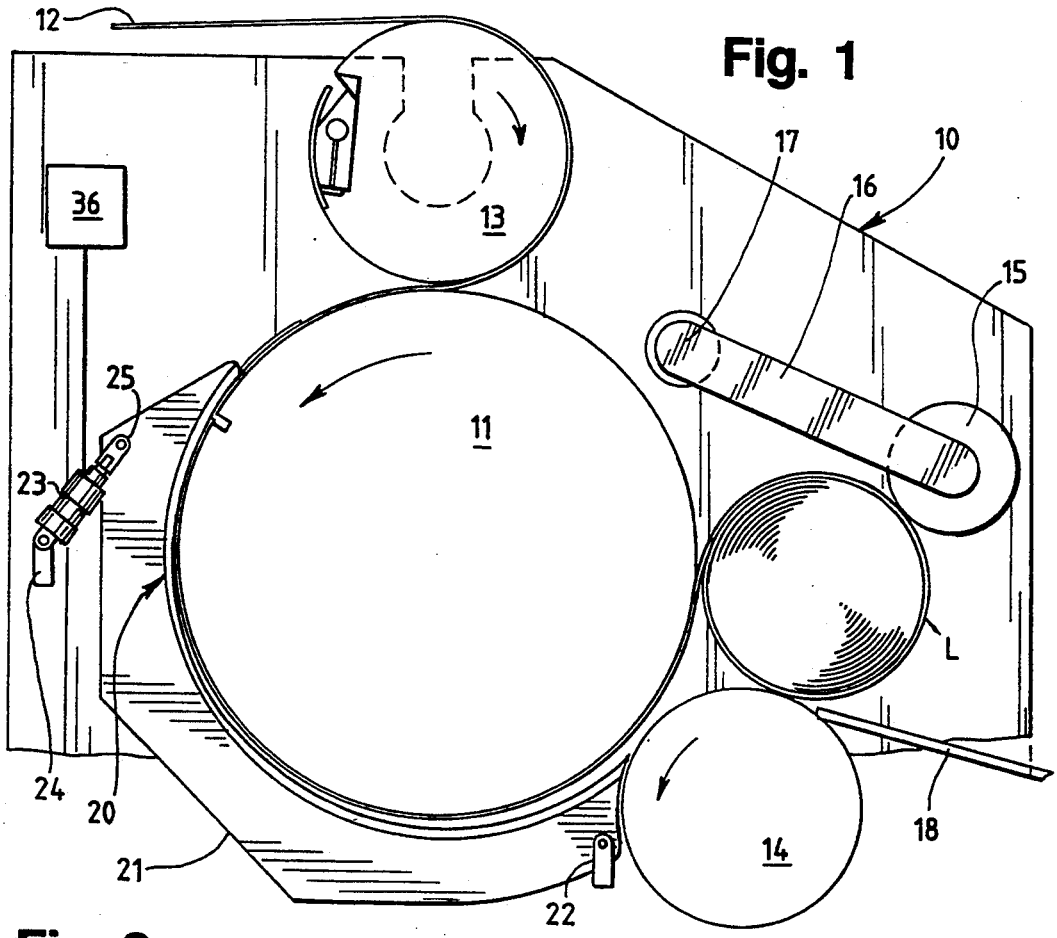
Fig. 1
Fig. 2
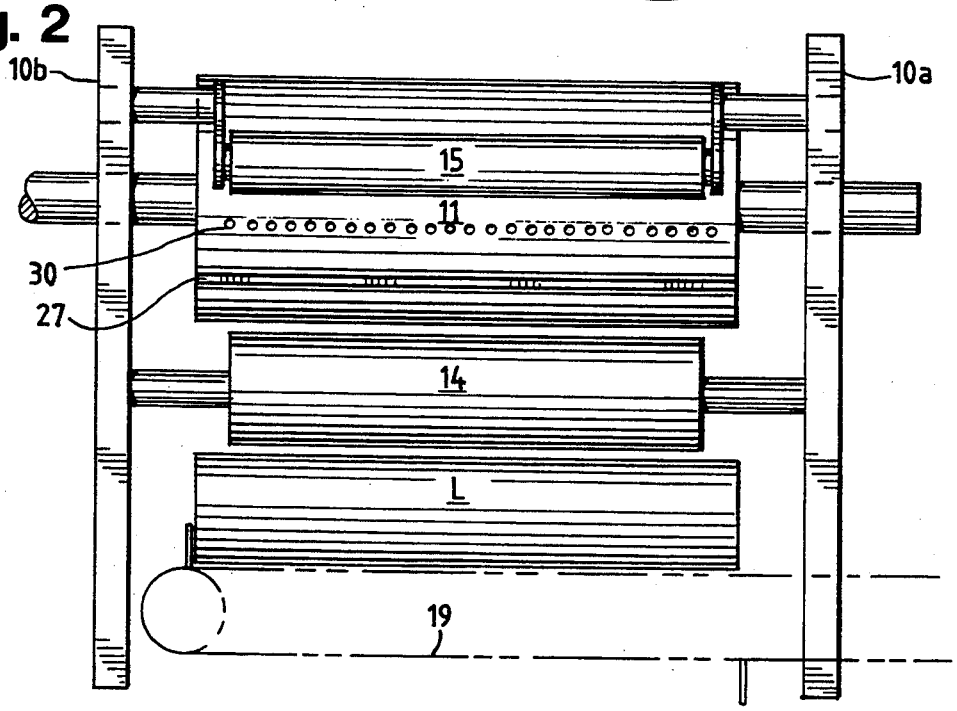

CORELESS SURFACE WINDER AND METHOD

BACKGROUND AND SUMMARY OF INVENTION

This invention relates to a coreless surface winder and method and, more particularly to a winder that does not use a core or mandrel but which produces a solid roll, i.e., there is no hole in the center with the resulting retail-size roll being "coreless". As such, the product is considered "environmentally friendly" in that there is less packaging material required and no core to dispose of.

Surface winders operate on the exterior of the paper being wound into a log and usually employ a three drum or roller cradle for this purpose—see, for example, co-owned U.S. Pat. No. 4,828,195. The three rollers usually include first and second winding rollers and a pivotally mounted rider roller. Historically, a core is introduced into the nip between the two winding rollers where it becomes enveloped with the web being wound—with the wind being completed when the incipient log is cradled among the three rollers. The log generally is of a length to provide a plurality of retail size rolls—each being about 4" (100 mm) to 5" (125 mm) length. These logs are continuously wound at high speed generally 2500–3000 fpm (750–900 mpm) resulting in 20–30 logs per minute having axial lengths of from about 100" (3 m) to about 200" (6 m).

According to the invention, there is no core and the wind is started by a rubbing motion brought about by introducing a folded leading edge of a severed web into the space between a bedroll-type winding drum and an arcuate, relatively elongated dead plate mounted in radially movable relation to the winding drum. At the speeds involved, it is only a fraction of a second for the leading edge to form an incipient roll or log and travel to the end of the dead plate (which extends only about a portion of the drum) and exit into the conventional three roller cradle.

Immediately after the incipient log passes the narrowest point, the dead plate is moved away from the drum to avoid accidental rubbing on the web but this movement is small, of the order of 0.01–0.10 inches and in the very short time mentioned above. To accommodate the buildup of convolutely wound layers, the deadplate contoured diverges slightly from the winding drum to provide increasing clearance as the new log progresses around the drum.

The phenomenon of a reverse folded leading edge is illustrated in detail in co-owned patent U.S. Pat. No. Re. 28,353. There, a portion of the web rearward of a severed leading edge is immobilized against the surface of a bedroll. When that occurs, windage and centrifugal force curl the leading edge on itself back to the immobilizing means which may be vacuum, pins, etc. In the '353 patent at transfer, pushers engaged the folded leading edge against the glue-equipped cores. The reverse fold was important to ensure the control of the leading edge by entrapping the two plies during the adhesion process. The advantage of the folded web, as described in the '353 patent, is the entrapment of the other ply when two ply tissue is being wound. If the leading edge was not controlled, it could fly away under the influence to the above mentioned factors: windage and centrifugal force. This would stop the winding.

The advantage of the folded web in the instant invention is to increase its width by at least two thicknesses, making it wide enough to cause the leading edge of the web to roll back onto itself as it enters the converging passage. So, it is clear that the operation of prior art winders is completely different from that of the instant invention. Hence, we have found another advantageous use of the reversely folded leading edge portion so as to be able to start a surface wind and thereby provide a solid roll.

Other objects, advantages and details of the instant invention may be seen in the ensuing specification.

BRIEF DESCRIPTION OF DRAWING

The invention is described in conjunction with the accompanying drawing, in which FIG. 1 is a side elevational view, somewhat schematic, of a winder embodying features of the invention;

FIG. 2 is an end elevational view of the winder of FIG. 1 in what might be considered a "developed" view, i.e., the various rolls being spread apart so as to better illustrate their arrangement;

FIG. 4 shows the cutoff which develops the reverse fold on the leading edge portion of the transversely severed web;

FIG. 5 is another fragmentary view like FIG. 4 and shows the beginning of the incipient roll;

FIG. 6 shows the roll or log being developed while FIG. 7 shows the relatively tiny diameter log issuing from the space between the dead plate and the drum for the finish of the wind in the three roller cradle.

DETAILED DESCRIPTION

Figure 3:
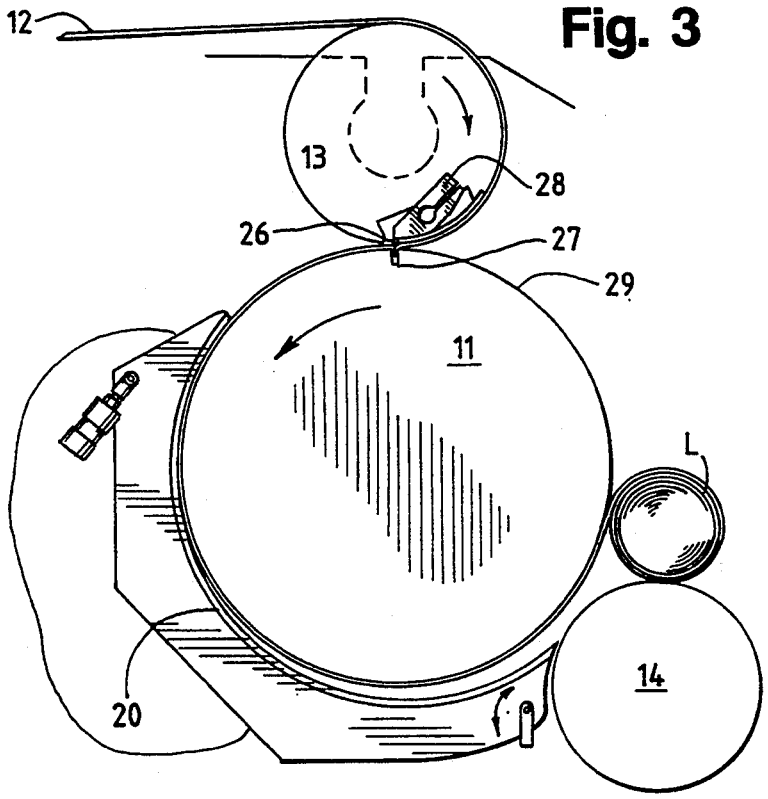
FIG. 3 is an enlarged fragmentary view of a portion of FIG. 1 and shows the beginning of the winding of a log according to the invention.

In FIG. 1, the numeral 10 designates generally a frame which is shown fragmentarily but which includes the usual side frames 10*a* and 10*b*—see FIG. 2. The frame 10 rotatably carries a bedroll-type drum 11 which is in the path of travel of a web 12.

The web 12 in its travel within the frame 10 toward becoming a convolutely wound log L travels with a knife roll 13 before engaging the drum 11.

The drum 11 is one of two winding rollers for surface winding—being accompanied by a second winding roller 14. Completing the three roller cradle conventionally employed in surface winding is a rider roller 15 which is supported on an arm 16 pivotally mounted on the frame as at 17. When the log L is completed it is carried by a roll down table 18 for further processing as by a takeaway conveyor 19—see the bottom of FIG. 2. The takeaway conveyor 19 moves the logs L transversely of the path followed by the web 12 and usually into a log saw (not shown). At the saw, the log is severed into retail size lengths and thereafter packaged. The three roller cradle and accompanying elements thus far described are essentially conventional.

THE INVENTION

The invention employs a dead plate generally designated 20 which is relatively elongated and arcuate so as to extend partway around the drum 11. The term "dead plate" is employed—as contrasted to a stationary plate—because the plate 20 is intended to move and does move each winding cycle. So, in that sense it is not stationary, but unlike the various rollers, there is no continuous rotary motion. However, there is a reciprocatory motion to accommodate the uneven web thickness as soon as the log passes the narowest point 35—see particularly FIGS. 5–7. The dead plate 20 is carried by a subframe 21 which in turn is pivotally mounted as at 22 on the frame 10. Actuation means for the pivoting of the subframe and therefore the dead plate 20 is provided in the form of a fluid pressure cylinder and piston rod unit 23 which is pivotally mounted as at 24 on the frame and pivotally connected to the subframe 21 as at 25. It will be appreciated that usually two such moving means as the unit 23 are employed—one adjacent one side frame 10*a*, 10*b* to provide a balanced, controlled movement of the dead plate 20.

Reference is now made to FIGS. 3–7 which illustrate the progressive development of a beginning log through the cooperation of the bedroll 11 and dead plate 20.

OPERATION (FIG. 3)

In FIG. 3 the knife roll 13 severs the web 12 by virtue of a knife 26 entering a slot 27 in the bedroll. The knife is suitably actuated by mechanisms such as that seen in U.S. Pat. No. Re. 28,353 and which actuate an arm 28 carrying the knife 26. This action, i.e., the knife 26 entering the slot in the surface or cylindrical periphery 29 of the drum 11 causes a transverse severance of the web. Other methods of cut-off can be used.

Figure 4:
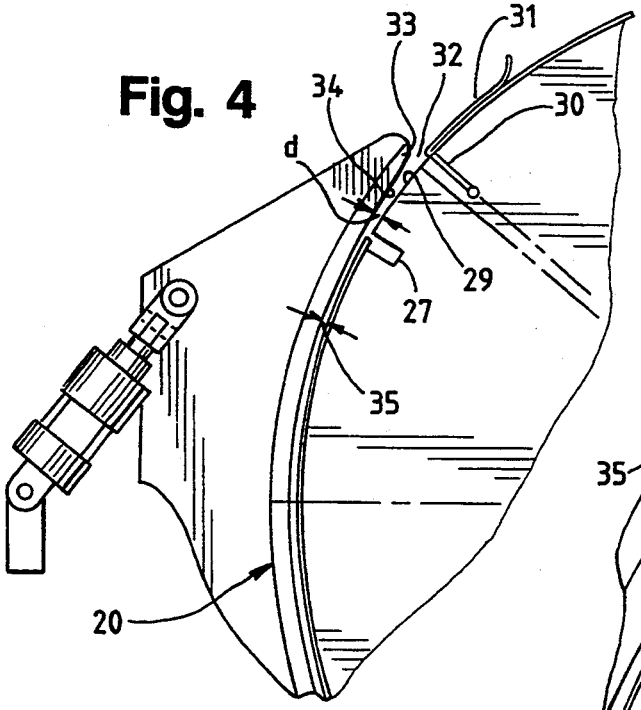
FIGS. 4–7 are views essentially similar to FIG. 3 but depicting the winding in subsequent stages thereof; for example

The web continues to be carried forward by transversely-extending series of vacuum ports 30 (see FIG. 4) in the drum—see also the upper portion of FIG. 2. As seen in FIG. 4, these ports 30 are positioned rearwardly of the cutoff slot 27 so as to allow the web leading edge portion 31 (see FIG. 4) to fold back on itself through the factors of the windage and drum motion.

OPERATION (FIG. 4)

FIG. 4 also shows the folded web about to enter the throat 32 of a converging passage between the dead plate 20 and the bedroll 11. At this stage of the wind cycle, the stationary plate is positioned at its upstream end 33 about 0.005" (0.125 mm) to about 0.030" (0.80 mm) (depending on web caliper) away from the drum 11. This develops a "throat" or entrance slot of sufficient height (radial dimension relative to the drum 11) to accommodate the double thickness 31 of the now-reversely folded web. The width dimension of the throat 32 and the reversely folded web is, of course, dependent on the width of the parent roll providing the web 12. The height or spacing between the cylindrical periphery 29 of the drum 11 and the confronting arcuate face 34 of the dead plate 20 is designated d, still referring to the upper central portion of FIG. 4.

The dimension d decreases between the throat 32 and the narrowest point 35 between the two confronting surfaces 29 and 34. At this point 35, the clearance is normally less than the folded caliper of the web leading edge portion 31 but more than the single thickness. As the folded edge portion 31 contacts the dead plate 20 (a short time after the showing in FIG. 4), the rubbing or shearing motion between the drum 11 and the dead plate 20 causes the leading edge to roll on itself—thereby developing an incipient log or beginning convolutions. More particularly, the rolling or shearing action is based on a torque being applied to the leading edge of the portion 31 tending to develop the rolling action referred to. The torque or movement is a function of the force $F_S$ referring now to FIG. 5) multiplied by the spacing d.

This torque becomes effective to start the leading edge 31 into forming an incipient log L' some place between the throat 32 and the constriction or narrowest point 35. The precise place where this occurs is not critical because it may vary due to the change in value of the spacing d between the throat 32 and constriction 35, the caliper and compressibility of the web 12, the character of the surfaces 29, 34, etc. What is important, however, is the outwardly radial movement of the dead plate 20, immediately after the incipient log has passed through the constriction 35. This is to enlarge the spacing d to permit the web of the incipient log L' to pass by what used to be the constriction or narrowest point 35 without starting another premature start of wind caused by creases in the web, vibration, etc.

Again, the precise time at which the dead plate 20 moves away from the surface 29 of the drum 11 is not important because it too may change dependent on a number of factors. This can be explained in conjunction with FIGS. 4 and 5.

OPERATION (FIGS. 4 AND 5)

In FIG. 4, the reversely-folded web 31 is about to enter the throat 32. This corresponds to the time when the row of ports 30 are aligned with the upstream end 33 of the dead plate 20. This point in time can be accurately determined but the precise point where the torque starts the development of the incipient log L' cannot be determined so accurately—see the discussion above.

Figure 5:
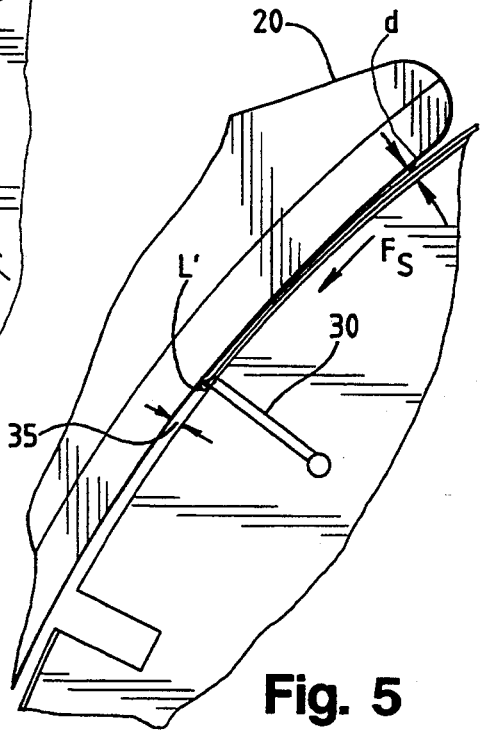

What is known is the rate of travel of the web 12—being equal to the surface speed of the drum 11. Between the throat 32 and the start of wind point of the incipient log, after the start of wind the speed is one-half the surface speed of drum 11. What is also known is the distance between the points 32 and 35. Once again the dead plate is moved after the log passes through the narrowest point 35. The log is expected to crush through the point 35, then the dead plate is moved. With a web speed of 300 fpm (900 mpm) and the arcuate distance between points 32 and 35 being about 3" (approximately 30 mm) based on a 7" (approximately 175 mm) diameter drum 11, the time lapse after the ports 30 pass the upstream end 33 is about 0.02 seconds. Therefore, the time lapse is directly proportional to the distance between points 32 and 35 and inversely proportional to the web speed. So FIG. 5 shows the situation shortly after the winding has started, viz., the presence of log L'. And, immediately after the incipient log L' has passed the constriction point 35 (the FIG. 6 situation), the dead plate 20 should either be moved or be in the process of being moved.

In FIG. 1, there is shown a controller 36 which is connected to the cylinder and piston rod unit 23 and which is also connected electrically to the drum 11 so as to develop a signal to the unit 23 to move the subframe 21 and thus the dead plate 20 away from the drum 11. Suitable controllers Model PIC 900 available from Giddings & Lewis located in Fond du Lac, Wis. Thus, the controller 36 constitutes a selective means for moving the dead plate 20 toward and away from the drum 1.

OPERATION (FIGS. 5–7)

Figure 6:
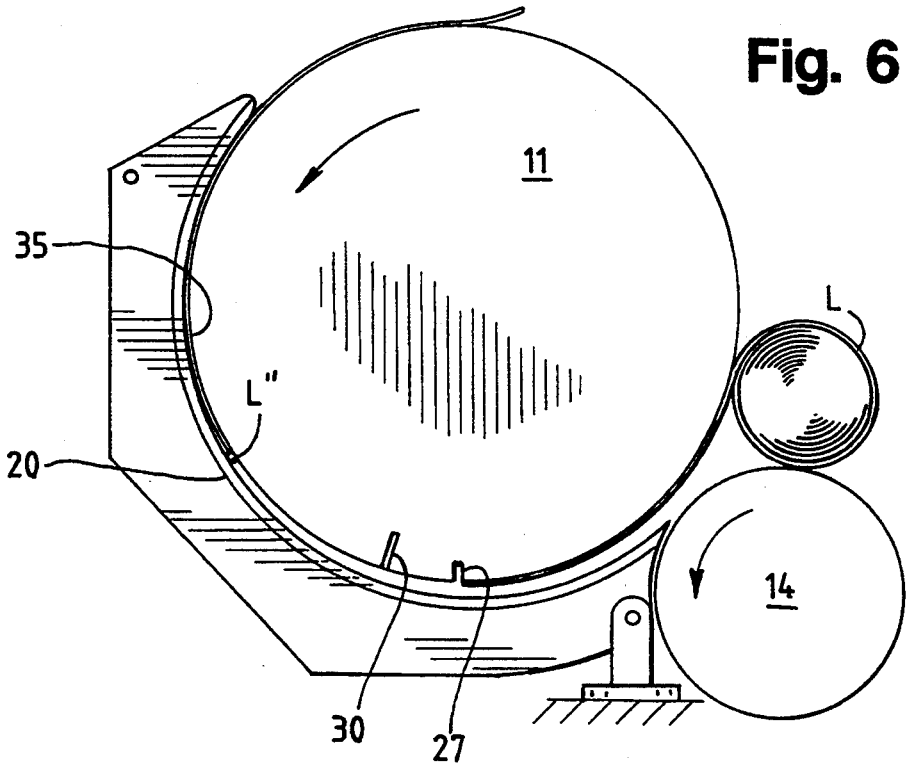
Figure 7:
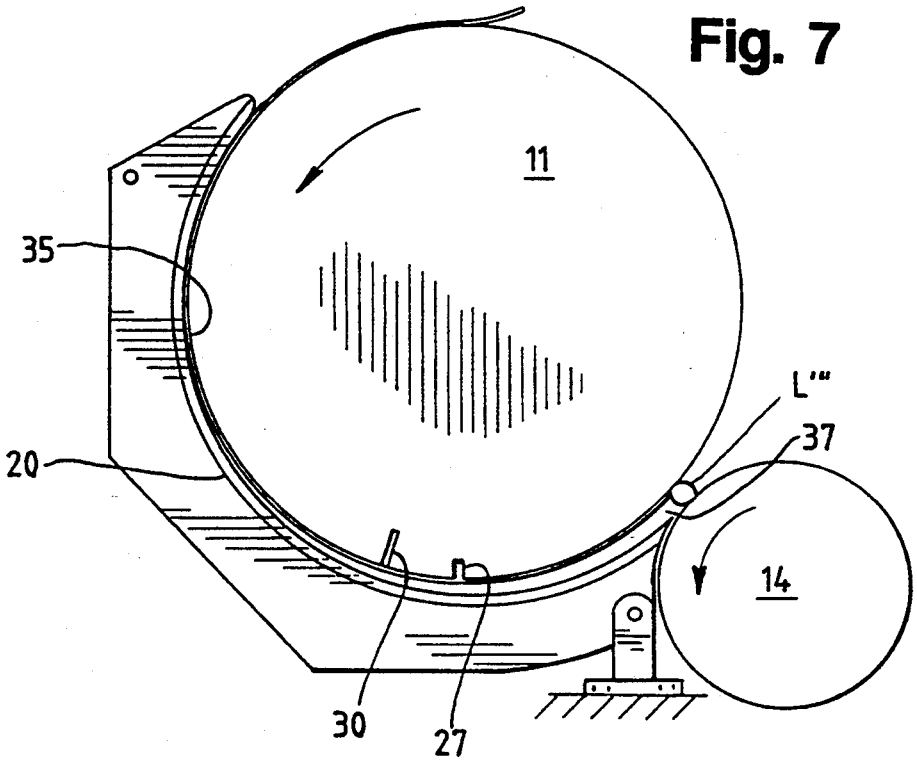

The rolling action continues with the incipient log L' moving forward on the stationary plate 20 at a rate equal to one-half of the surface speed of the drum 11. The dead plate 20 is contoured so that the clearance d first decreases over a first segment up to a point 35 after which the clearance increases approximately in accordance with the increase in diameter of the log now being wound. FIG. 6 shows this progressing stage with the incipient log now being designated L''.

When the new incipient log L''' reaches the end of the dead plate 20 (see FIG. 7) it rolls onto the second or lower winding roll 14 and passes through the nip 37 between the first and second winding rolls 11, 14. Motion through the nip 37 is brought about due to a slight speed differential during this part of the wind cycle. More particularly, the surface speed of the lower winding roll 14 is slightly less than that of the bedroll 11. Thereafter, the winding continues as discussed above. Soon after the web of a completed log is cut, the controller 36 reverses the prior "away" movement and pivots the subframe 21 into position for receiving another reverse fold. This could be after a lapse of 2–3 seconds, based upon web speed.

While in the foregoing specification a detailed description of an embodiment of the invention has been set down for the purpose of illustration, many variations in the details hereingiven may be made by those skilled in the art without departing from the spirit and scope of the invention.

We claim:

1. Apparatus for convolute winding a web log comprising a frame, a drum rotatably mounted in said frame and constituting a first winding roller, means for advancing a web for travel with the circumferential surface of said drum, a second winding roller rotatably mounted in said frame adjacent said first winding roller, a rider roller pivotally mounted in said frame and forming with said first and second winding rollers a three roller cradle, a knife roller rotatably mounted in said frame adjacent said drum and equipped with knife means for severing said web, said drum being equipped with slot means for receiving said knife means, said knife means and slot means being engageable for severing said web along a transverse line, means operably associated with said drum for immobilizing a free portion of said web against the surface of said drum, said immobilizing means being located a spaced distance rearward in the direction of drum rotation from said slot means to cause a severed web to fold rearwardly, a relatively elongated, arcuate dead plate located downstream from said immobilizing means and extending around a segment of the surface of said drum between said knife roller and said second winding roller, said dead plate being spaced from said drum a distance to cause said rearward fold to rub against said dead plate and roll on itself to develop an incipient log.

2. The apparatus of claim 1 in which said apparatus includes control means for selectively moving said dead plate toward and away from said drum to vary the spacing therebetween.

3. The apparatus of claim 1 in which said dead plate at one end defines with said drum a web inlet and at the other end an outlet, said dead plate being arcuate about two different radii, a first arcuate portion commencing at said inlet and being radially convergent in proceeding toward said outlet end but terminating at a point intermediate the plate length, and a second arcuate portion commencing at said intermediate point and being radially divergent in proceeding toward said outlet end.

4. The apparatus of claim 1 in which said plate is provided as part of a subframe, and means pivotally mounting said subframe on said frame to vary the spacing of said plate from said drum.

5. The apparatus of claim 4 in which said pivotally mounting means is positioned adjacent said second winding roller.

6. The apparatus of claim 1 in which said immobilizing means includes vacuum port means terminating in said drum surface for immobilizing a free portion of said web by a vacuum.

7. In a method of winding a web into a convolutely wound log without providing an axially extending opening in the log, the steps of providing a three roller surface winding cradle including a rotatable drum, a knife roll associated with said drum and an arcuate, relatively elongated dead plate extending around a surface segment of said drum and spaced therefrom to define with said drum an end providing a web inlet and an end providing an outlet, introducing a web into said inlet for travel with the circumferential surface said drum, transversely severing said web with said knife roll and substantially simultaneously therewith immobilizing on said drum a free portion of said web at a predetermined distance rearward in the direction of drum rotation of said transverse severing to develop a reverse fold in said web, introducing said web fold into said inlet, subjecting said web reverse fold to rubbing action between said dead plate and drum to cause said web fold to roll on itself to form an incipient log, and after said incipient log reaches said outlet, introducing said incipient log into said three roller winding cradle.

8. The method of claim 7 in which said steps include traveling said reverse fold in a radially convergent portion of the space between said drum and dead plate to produce a convolution in said reversely-folded web.

9. The method of claim 7 in which said immobilizing step includes applying vacuum to said web free portion.

10. The method of claim 7 in which said steps include adjusting the space between said dead plate and drum to correspond to the web caliper.

11. The method of claim 10 in which said adjusting step includes adjusting the spacing in the range of about 0.005" to about 0.030" depending upon the caliper of the web.

12. The method of claim 7 in which said steps include moving said dead plate away from said drum shortly after said reverse fold has entered said web inlet.

13. The method of claim 12 in which said steps include providing a constriction in the spacing between said drum and dead plate intermediate the ends of said dead plate, and moving said dead plate away from said drum immediately after said incipient log has passed through said constriction.

14. In a method of winding a web into a convolutely wound log without providing an axially extending opening in the log, the steps of providing a three roller surface winding cradle including a rotatable drum, a knife roll associated with said drum and an arcuate, relatively elongated dead plate extending around a surface segment of said drum and spaced therefrom to define with said drum an end providing a web inlet and an end providing an outlet, introducing a web into said inlet for travel with the circumferential surface of said drum, transversely severing said web with said knife roll and substantially simultaneously therewith immobilizing on said drum a free portion of said web at a predetermined distance rearward in the direction of drum rotation of said transverse severing to develop a reverse fold in said web, introducing said web fold into said inlet, subjecting said web reverse fold to rubbing action between said dead plate and drum to cause said web fold to roll on itself to form an incipient log, and after said incipient log reaches said outlet, introducing said incipient log into said three roller winding cradle, said steps including moving said reverse fold in a radially convergent portion of the space between said drum and dead plate to produce a convolution in said web, and moving said dead plate away from said drum at about the time said convolution is produced.

15. The method of claim 14 in which said steps include adjusting the time of dead plate movement as a direct function of the length of said convergent portion and an inverse function of the surface speed of said drum.

16. The method of claim 14 in which said steps include providing a constriction in the space between said drum and dead plate, between said web inlet and outlet, and moving said dead plate away from said drum when said convolution passes said constriction.

* * * * *